US010256522B2

(12) United States Patent
Zhai et al.

(10) Patent No.: US 10,256,522 B2
(45) Date of Patent: Apr. 9, 2019

(54) VERTICAL COMBINER FOR OVERLAPPED LINEAR PHASED ARRAY

(71) Applicant: Huawei Technologies Co., Ltd., Shenzhen (CN)

(72) Inventors: Wenyao Zhai, Kanata (CA); Vahid Miraftab, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 110 days.

(21) Appl. No.: 15/077,246

(22) Filed: Mar. 22, 2016

(65) Prior Publication Data

US 2017/0279178 A1 Sep. 28, 2017

(51) Int. Cl.

| | |
|---|---|
| ***H01P 5/18*** | (2006.01) |
| ***H01Q 21/00*** | (2006.01) |
| ***H01P 5/12*** | (2006.01) |
| ***H01Q 21/06*** | (2006.01) |
| *H01P 5/02* | (2006.01) |

(52) U.S. Cl.
CPC ..... *H01P 5/184* (2013.01); *H01P 5/12* (2013.01); *H01Q 21/0006* (2013.01); *H01Q 21/065* (2013.01); *H01P 5/028* (2013.01)

(58) Field of Classification Search
CPC ..... H01Q 21/0006; H01P 5/184
USPC ..... 343/852
See application file for complete search history.

(56) References Cited

U.S. PATENT DOCUMENTS 5,222,246 A * 6/1993 Wolkstein ..... H03F 3/602 330/107
5,952,964 A * 9/1999 Chan ..... H01Q 3/22 342/368
6,114,997 A 9/2000 Lee et al.
6,154,176 A * 11/2000 Fathy ..... H01Q 1/38 343/700 MS
8,350,771 B1 * 1/2013 Zaghloul ..... H01Q 9/0435 343/700 MS (Continued)

FOREIGN PATENT DOCUMENTS

CN 201191649 Y 2/2009
CN 103296487 A 9/2013

(Continued)

OTHER PUBLICATIONS

International Search Report for PCT/CN2016/110119 dated Mar. 22, 2016.

(Continued)

*Primary Examiner* — Dieu Hien T Duong
*Assistant Examiner* — Bamidele A Jegede

(57) ABSTRACT

A vertical combiner for an overlapping linear phased array is provided. The vertical vector combiner enables two strip-line signals from different layers to be combined, or divided, by vertical transitions between substrate layers and produce a desired output signal phase. The combiner can terminate in a short to act as an antenna. In an antenna application, the antenna provides multiple substrate layers for each strip-line signal, each having a metal ground plane. The ground planes are be coupled by vertical transitions access enabling a stepped ground within the structure which increases bandwidth. The multi-layer combiner architecture enables integration with phased array feed networks for millimeter wave phased array antennas.

20 Claims, 12 Drawing Sheets

(56) References Cited

U.S. PATENT DOCUMENTS

| | | | | |
|---|---|---|---|---|
| 2002/0163468 | A1* | 11/2002 | Anderson | H01Q 9/0428 343/700 MS |
| 2003/0030508 | A1* | 2/2003 | Wangsvick | H01P 5/12 333/100 |
| 2003/0164797 | A1* | 9/2003 | Ngai | H01Q 1/523 343/700 MS |
| 2004/0027292 | A1* | 2/2004 | Gabriel | H01Q 9/0414 343/700 MS |
| 2005/0048934 | A1* | 3/2005 | Rawnick | H01Q 9/0442 455/107 |
| 2006/0152414 | A1* | 7/2006 | Peshlov | H01Q 21/0075 343/700 MS |
| 2007/0146206 | A1* | 6/2007 | Sun | H01Q 9/0435 343/700 MS |
| 2007/0262873 | A1* | 11/2007 | Tsirline | G06K 7/10316 340/572.7 |
| 2008/0111650 | A1* | 5/2008 | Kuo | H01P 5/184 333/116 |
| 2008/0180329 | A1* | 7/2008 | Takeishi | H01Q 13/18 343/700 MS |
| 2009/0315634 | A1* | 12/2009 | Sertel | H01P 1/184 333/1 |
| 2012/0112857 | A1* | 5/2012 | Lim | H01P 1/2039 333/238 |
| 2014/0043189 | A1* | 2/2014 | Lee | H01Q 13/20 342/368 |
| 2014/0240186 | A1* | 8/2014 | Zhou | H01Q 13/06 343/772 |

FOREIGN PATENT DOCUMENTS

| | | | |
|---|---|---|---|
| CN | 104638360 | A | 5/2015 |
| CN | 104682020 | A | 6/2015 |
| CN | 104953256 | A | 9/2015 |

OTHER PUBLICATIONS

Azar, Tony, "Overlapped Subarrays: Review and Update," IEEE Antennas and Propagation Magazine, vol. 55, No. 2, 2013.

Abbaspour-Tamijani, A., et al., "An Affordable Millimeter-Wave Beam-Steerable Antenna Using Interleaved Planar Subarrays," IEEE Transactions on Antennas and Propagation, vol. 51, No. 9, pp. 2193-2202, 2003.

Sanadgol, Bahram, et al., "60 GHz Substrate Integrated Waveguide Fed Steerable LTCC Antenna Array," Proceedings of the Fourth European Conference on Antennas and Propagation, pp. 1-4, 2010.

Lee, Jong-Hoon et al., "Advanced 3D LTCC Passive Components Using Cavity Structures for 60 GHz Gigabit Wireless Systems," 2006 Asia-Pacific Microwave Conference, pp. 356-359, 2006.

Tsai, Chih-Chun, et al., "Design of Microstrip-to-Microstrip Via Transition in Multilayered LTCC for Frequencies up to 67 GHz," IEEE Transactions Components, Packaging and Manufacturing Technology, vol. 1, No. 4, pp. 595-601, 2011.

Abbaspour-Tamijani, A., et al., "Planar Implementation of the Partially Overlapped Subarrays for Millimeterwave Beam Steerable Antenna Applications," 2002 IEEE MTT-S International Microwave Symposium Digest, vol. 1, pp. 53-56, 2002.

U.S. Appl. No. 14/997,288, "Overlapping Linear Sub-Array for Phased Array Antennas," filed Jan. 15, 2016.

* cited by examiner

300

400

500

700

VERTICAL COMBINER FOR OVERLAPPED LINEAR PHASED ARRAY

TECHNICAL FIELD

The current disclosure relates to phased array antennas for use in communication systems and in particular to vertical combiner for an overlapping linear phased array.

BACKGROUND

Phased array antennas can be used in a variety of different wireless communication networks, and they can be used to enable steering of the transmission and/or reception in both the azimuth and elevation planes. Steering transmission and reception allows for an antenna array to direct the transmission or reception resources towards a particular location, which can increase the system capacity, that is networks designed to provide service to mobile devices, there is increased interest in beam steering as it allows for better concentration of connectivity resources to the spatial locations that need them. A relatively large array is required in order to achieve desirable directivity. In conventional phased array design there is one phase shifter, delay line and/or amplitude control per array element. This increases both the cost and complexity of manufacture of the array. The operating bandwidth of the phased array system is usually limited by the operating bandwidth of the antenna elements as compared to its feed network which can be dictated by sub-array structure. In addition the sub-array structure provides a limited field of view array its steerablity is also a function to the individual antenna element directivity.

It is desirable to have an additional, alternative and/or improved combiner and will provide desired phases to individual elements for an overlapped linear sub-array for communication systems.

SUMMARY

In accordance with an aspect of the present disclosure there is provided a vertical electrical signal combiner comprising: a first feed substrate layer having a first strip-line signal feed; a second feed substrate layer having a second strip-line signal feed; and a combiner substrate layer interposed between the first feed substrate layer and the second feed substrate layer, the combiner layer having a strip-line Y-coupler coupled to the first strip-line signal feed and the second strip-line signal feed by vertical signal transitions through, respectively, the first and combiner substrate layers wherein the combiner provides a resultant signal that is a vector sum of a first signal from the first strip-line signal feed and a second signal from the second strip-line. An antenna element comprising the vertical vector is provided where the first feed substrate layer has a slot in a ground plane portion of the first feed substrate layer, the slot positioned above the short of the strip-line of the combiner.

In accordance with yet another aspect of the present disclosure there is provided an overlapped linear sub-array comprising: a plurality of antenna elements arranged in a plurality of rows and columns, each of the plurality of antenna elements comprising: a first feed substrate layer having a first strip-line signal feed; a second feed substrate layer having a second strip-line signal feed;

and a combiner substrate layer interposed between the first feed substrate layer and the second feed substrate layer, the combiner layer having a strip-line coupling the first strip-line signal feed with the second strip-line signal feed wherein the combiner layer is coupled to the first strip-line signal feed and second strip-line signal feed by vertical signal transitions between the respective substrate layers and the combiner substrate layer wherein the combiner provides a resultant signal that is a vector sum of a first signal from the first strip-line signal feed and a second signal from the second strip-line; and an antenna element positioned above the first feed substrate layer; a feeding network for providing a respective column driving signal to one of the first or second strip-line signal feed of the combiner of each of the antenna elements in a respective column and a respective row driving signal to the other one of the first or second strip-line signal feed of the combiner of each of the antenna elements in a respective row.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Embodiments are described below, by way of example only, with reference to FIGS. 1-12. Although phased arrays can be used in many different network implementations, including in third and fourth generation (3G/4G) mobile networks, such as those supporting the Long Term Evolution (LTE) networking standards defined by the Third Generation Partnership Project (3GPP), the following discussion will be directed to the application of phase array in next generation wireless networks, such as fifth generation wireless networks (5G) and millimeter wave wireless applications. This should not be viewed as limiting the scope of applicability of phase array antennas.

In order to provide the performance desired for next generation wireless networks such as 5G, networks may include phased array antennas in transmitters and receivers to allow transmission beams to steered and to allow receivers to be directed in both an azimuth plane as well as an elevation plane. The antenna structure described utilizes a vertically stacked combiner to combine two millimeter wave signals in a strip-line (SLIN) environment provided on different layers of the antenna structure. Based on the phases of the incoming signals a combined output signal is provided to an antenna element. The combiner structures described can also be used as a phase shifter in a phased array design. The vertical vector combiner structure for overlapped linear sub-array enables unique wideband SLIN fed antenna elements which uses symmetrical feed and power combined in three different SLIN substrate layers. Multiple ground layers are provided in the antenna structure which enhances the both bandwidth and directivity of an antenna element.

Figure 1:
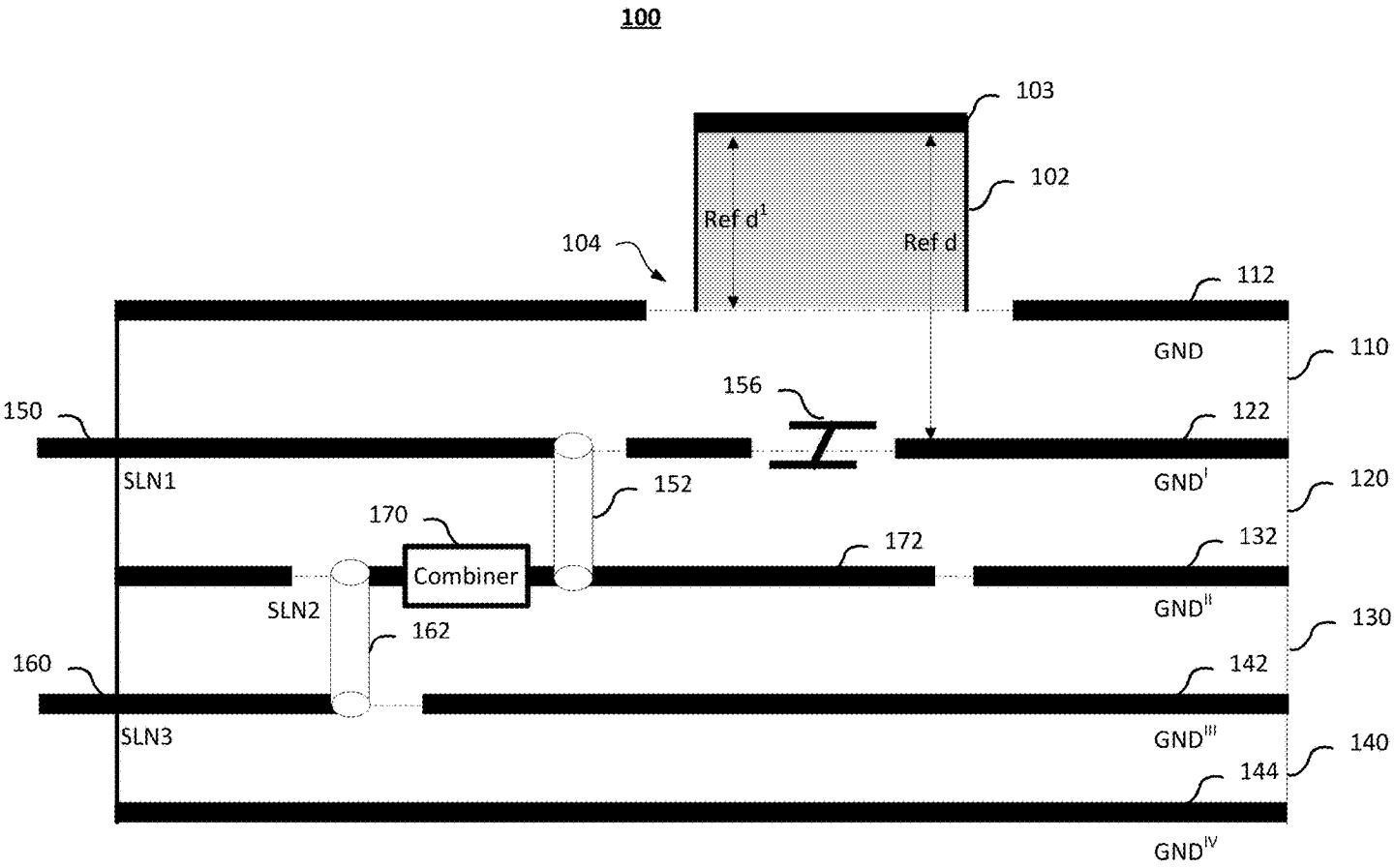
FIG. 1 shows a representation of antenna structure using a vertical combiner.

FIG. 1 shows a representation of antenna structure using a vertical combiner. The antenna 100 comprises a four substrate layers 110, 120, 130, 140 with six metal layers. Each dielectric substrate layer 110, 120, 130, 140 has respective conductor ground layers 112, 122, 132, 142, 140 and 144 which can be connected together by vertical transition access (vias) through the substrate layers.

An antenna element substrate layer 102, having a top metal layer 103, is positioned within an opening 104 in a ground plane 112 of substrate 110. SLIN1 150 and SLIN3 160 enter the antenna structure on respective layers 120 and 140. A combiner 170 is provided on intermediary layer 130 which receives an electrical signals from SLIN1 via a vertical transition 152 and an electrical signal from SLIN3 via vertical transition 162 between the respective ground planes disposed between the layers. The combiner 170 on the intermediary layer 130 combines the SLIN1 150 and SLIN3 160 to generate a combined electrical signal with desired phase from SLIN2 by combiner 170.

The combiner 170 terminates in a short 172 which is centre aligned with an 'H' slot 156 forming an opening in the ground plane 122. The short 172 fed the antenna by radiating up through the 'H' slot 156 which is centered underneath the antenna element 102. A stepped ground is provided by coupling the ground layers on the substrates within the antenna structure. The antenna element substrate layer 102 dimensions can be determined in reference to two ground references 'Ref d' and 'Ref $d^1$' defining the distance required for two resonance frequencies of the antenna. The bandwidth of the antenna is a function of distance between the antenna element and its reference ground, which may for example be approximately 300 μm in thickness, whereas each substrate may be approximately 100 μm in thickness although other dimensions may be utilized depending on the frequency characteristics of the antenna.

Figure 2:
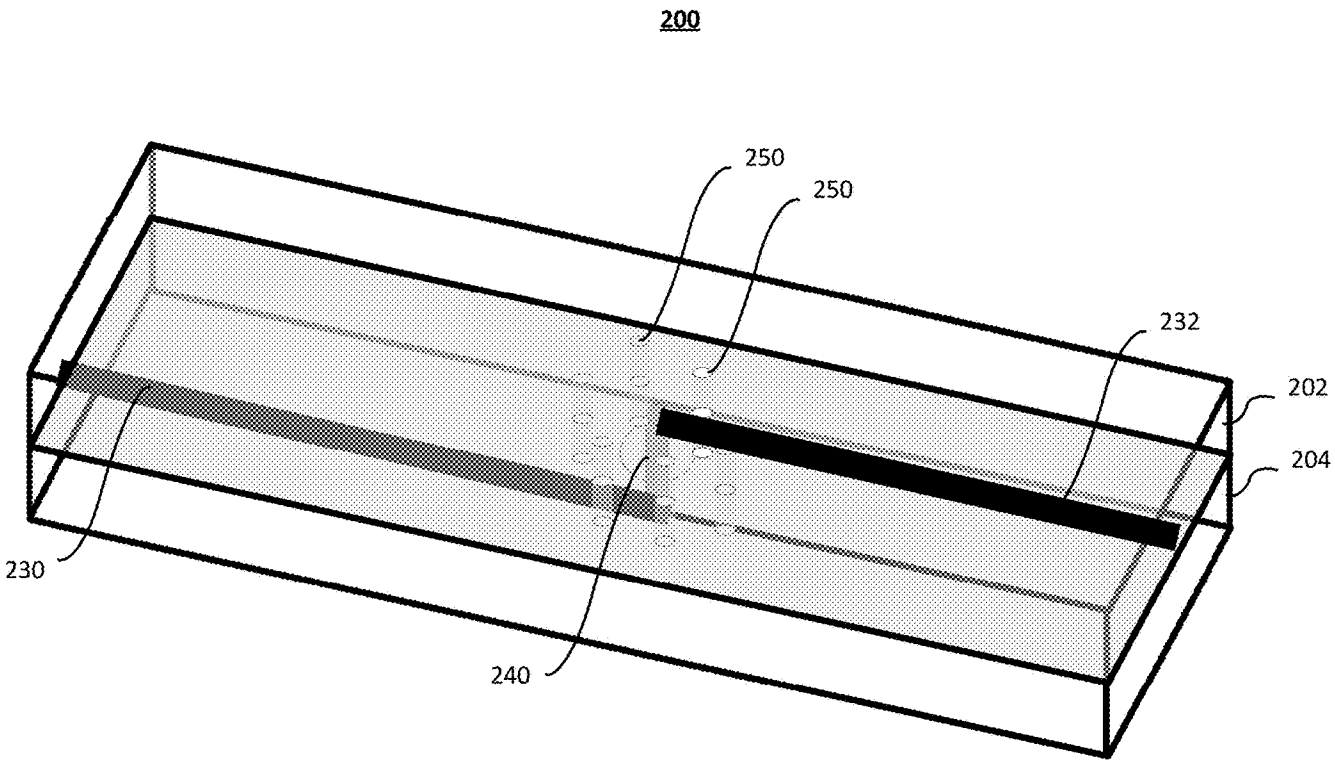
FIG. 2 shows a perspective view of a vertical transition structure.
Figure 3:
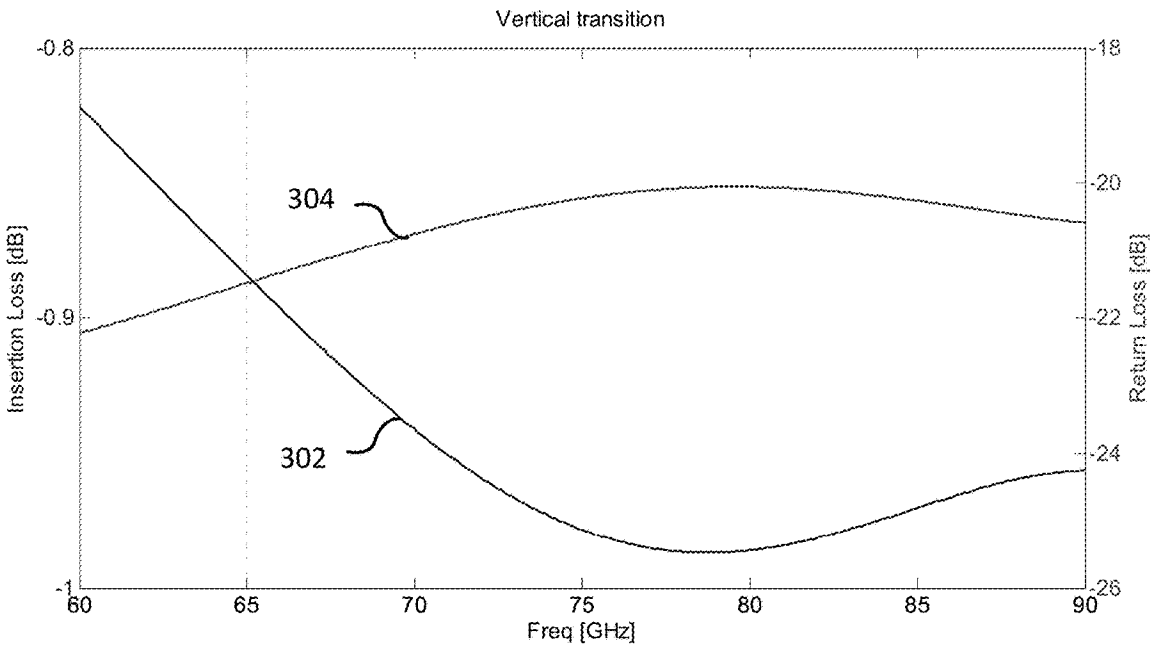
FIG. 3 shows a graph of insertion loss and return loss for a vertical transition structure.

FIG. 2 shows a perspective view of a vertical transition structure used with the antenna design 100, or which may be utilized in other antenna feed structures. The vertical transition 200 enables SLIN 230 and SLIN 232 to be connected between separate substrate layers 202 and substrate layer 204. The vertical transition 240 passes through an opening in the ground plane to couple the layers SLIN 230 and SLIN 232 between the substrate layer 202 and 204. The ground planes of the substrate layers can be coupled by vias 250 that go through the plane of adjacent layers. The radial distance between the shielding vias 250 to the signal via 240 is optimized to achieve best performances. Referring to FIG. 3, a graph 300 shows insertion loss 302 and return loss 304 in the E-band frequency spectrum for a vertical transition. The vertical transition structure between layers provides low insertion loss and improves return loss across the spectrum range.

Figure 4:
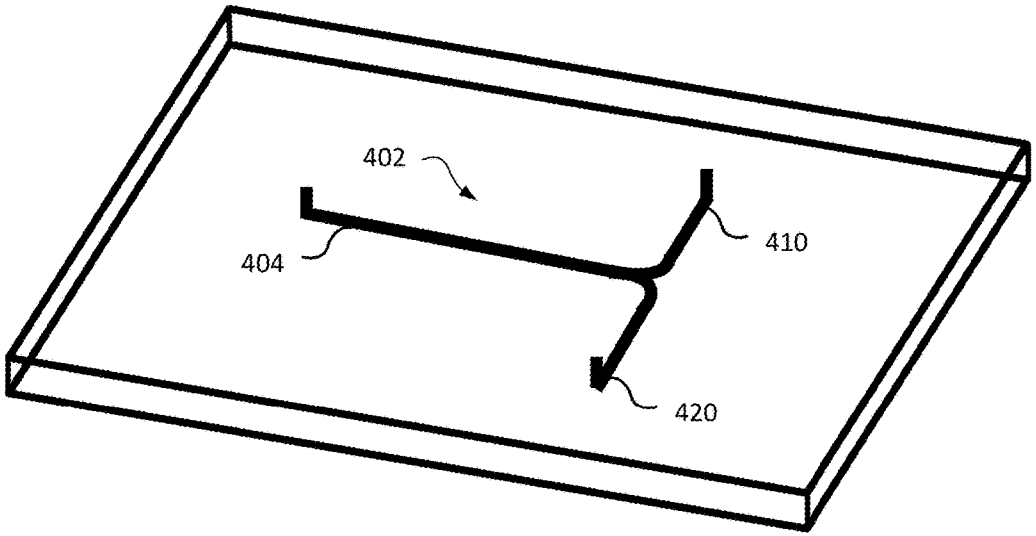
FIG. 4 shows a perspective view of power combiner structure.
Figure 5:
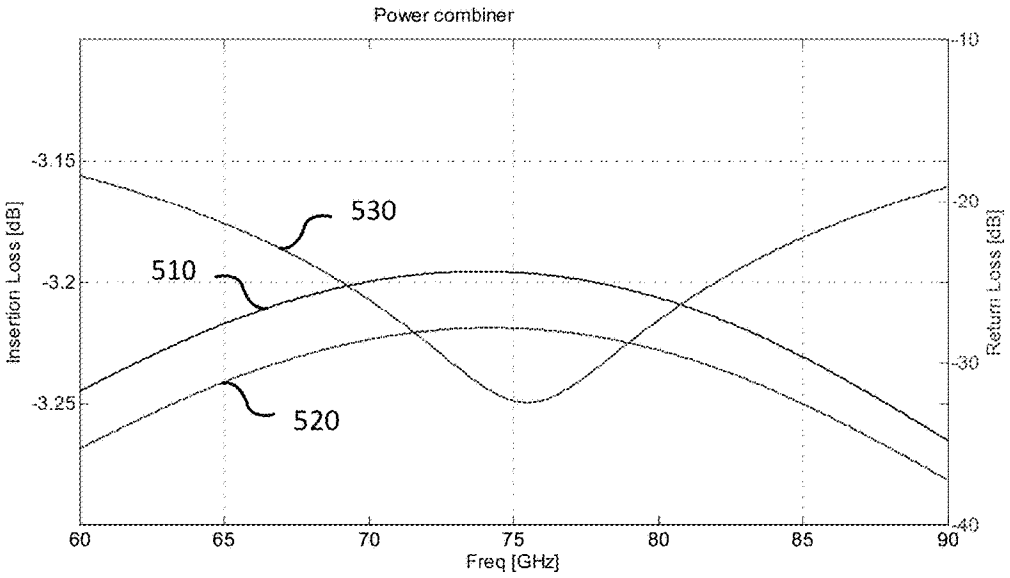
FIG. 5 shows a graph of insertion loss and return loss for the power combiner structure.

FIG. 4 shows a perspective view of power combiner structure 400 utilized with the antenna design 100. The combiner layer 400 provides a 'Y' coupler 402 for receiving SLIN at portions 410 and 410. The SLIN signals are combined to a short 404 which acts and an antenna for the combined signal. The widths and length of the combiner is optimized for best performance. Referring to FIG. 5, the graph 500 shows combiner insertion loss 510 and divider insertion loss 520 for the combiner which provides consistent performance in both directions of the combiner structure 402. The return loss 530 for the power combiner 402 peaks at approximately 75 GHz at −3.2 dB and the return loss is at ~−32 dB.

Figure 6:
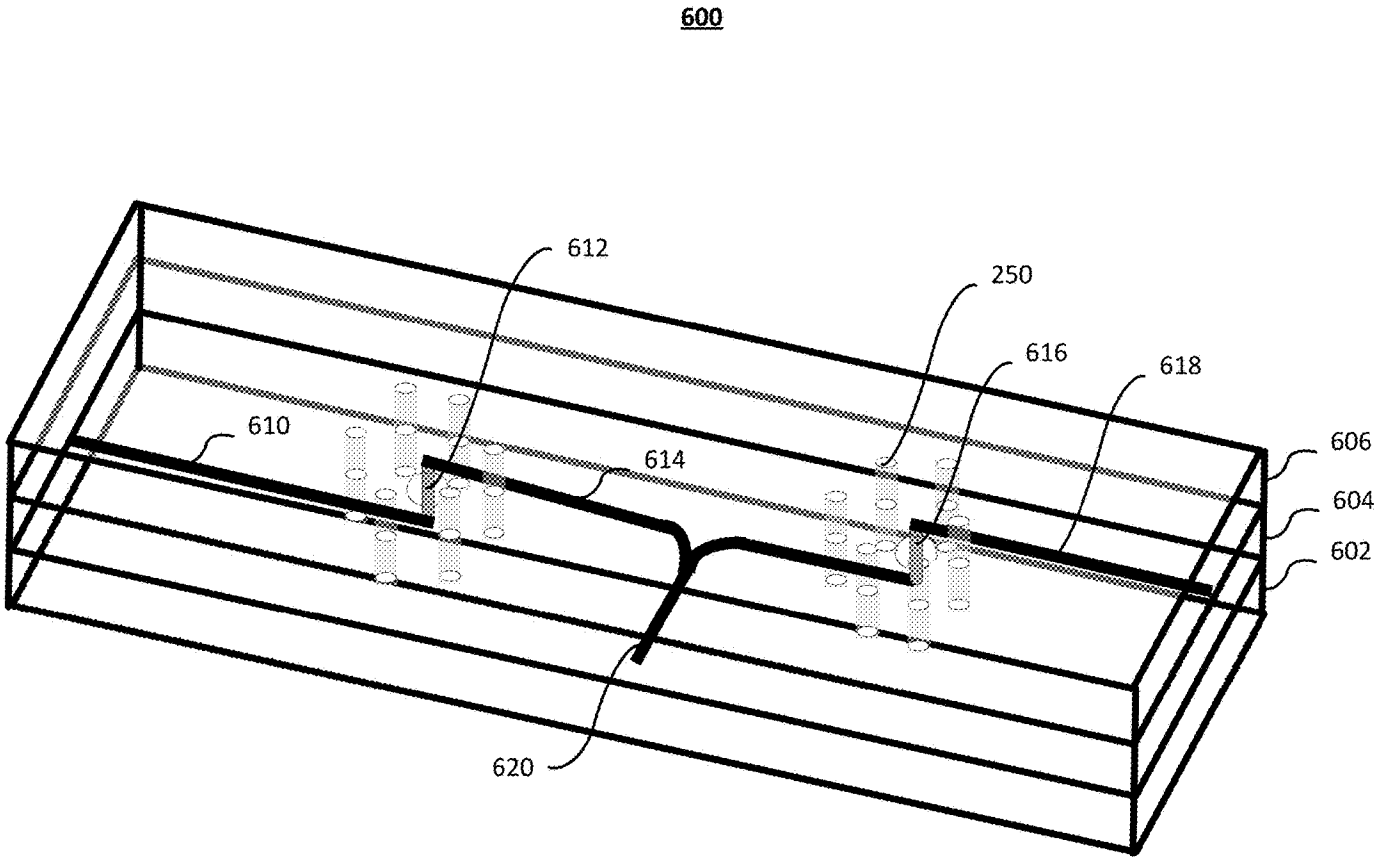
FIG. 6 shows a perspective view of a vertical transition and power combiner structure.
Figure 7:
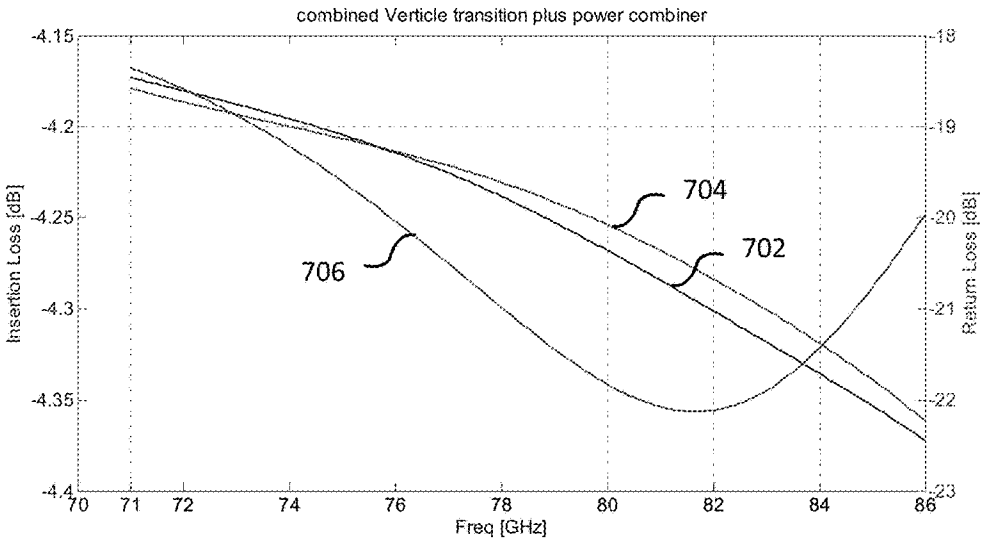
FIG. 7 shows a graph of insertion loss and return loss for the vertical transition and power combiner structure.

FIG. 6 shows a perspective view of a vertical transition and power combiner structure 600. An SLIN 610 is provided on the first layer 602 which transitions via a vertical transition 612 to the combiner 614 on layer 604. The combiner 614 also receives SLIN 618 from layer 606 via vertical transition 616. The combiner 614 can then transition to a short 614 or connect to other elements or transition structures. As with the vertical transition structure shown in FIG. 6, vias 250 couple the ground layers of each substrate 202 and 204. The combiner 614 provides a resultant signal that is a vector sum of the signals of SLINs 610 and 618. Although the structure has been described as a combiner, it may be utilized as a power divider where the short 614 would provide one input 620 to two outputs 610 and 618. Referring to FIG. 7 a graph 700 shows combiner insertion loss 702 and divider insertion loss 704, which is consistent with the combiner insertion loss, in addition to the return loss 702 for the vertical transition and power combiner structure 600.

Figure 8:
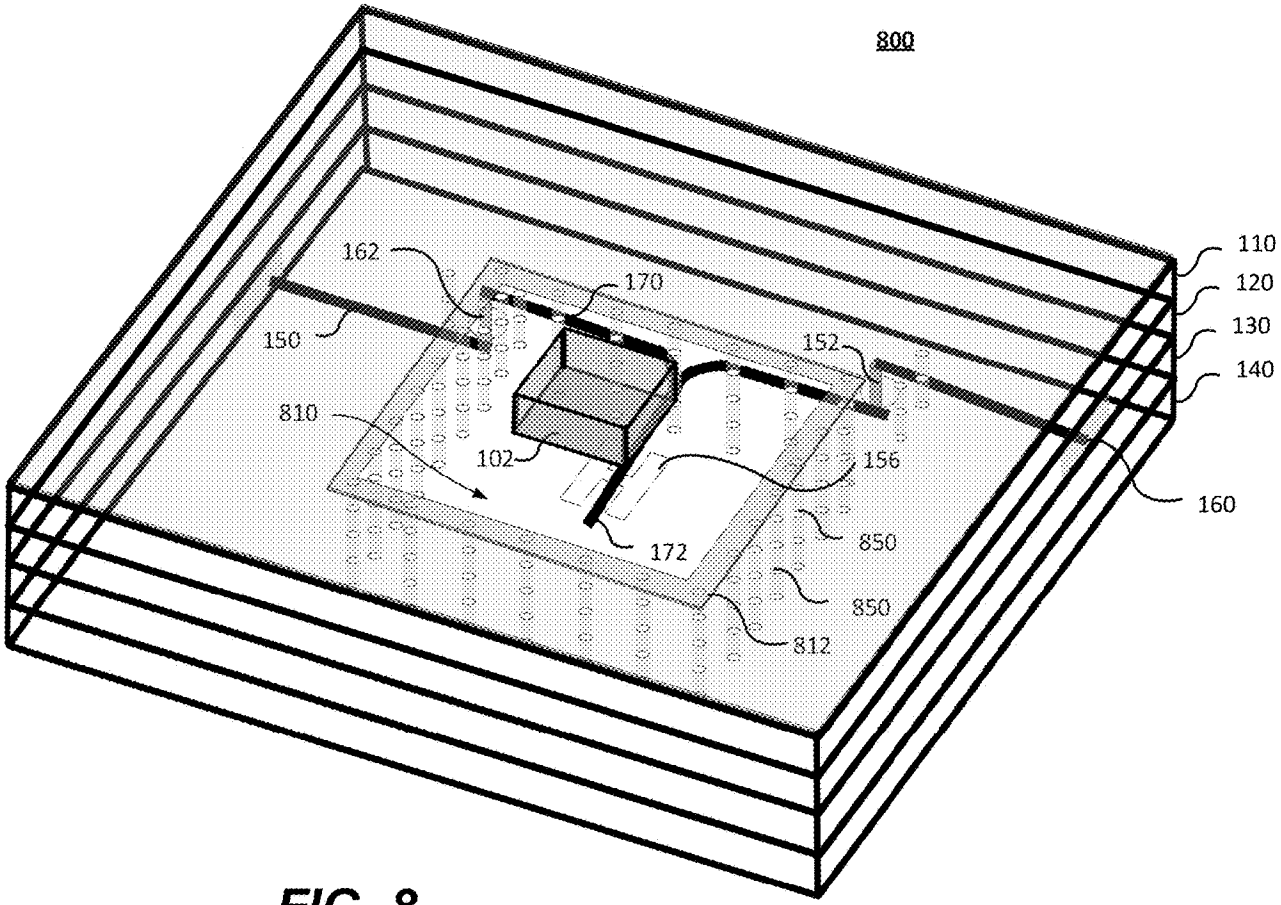
FIG. 8 shows a perspective view of an antenna element fed by the vertical transition and power combiner structure.
Figure 9:
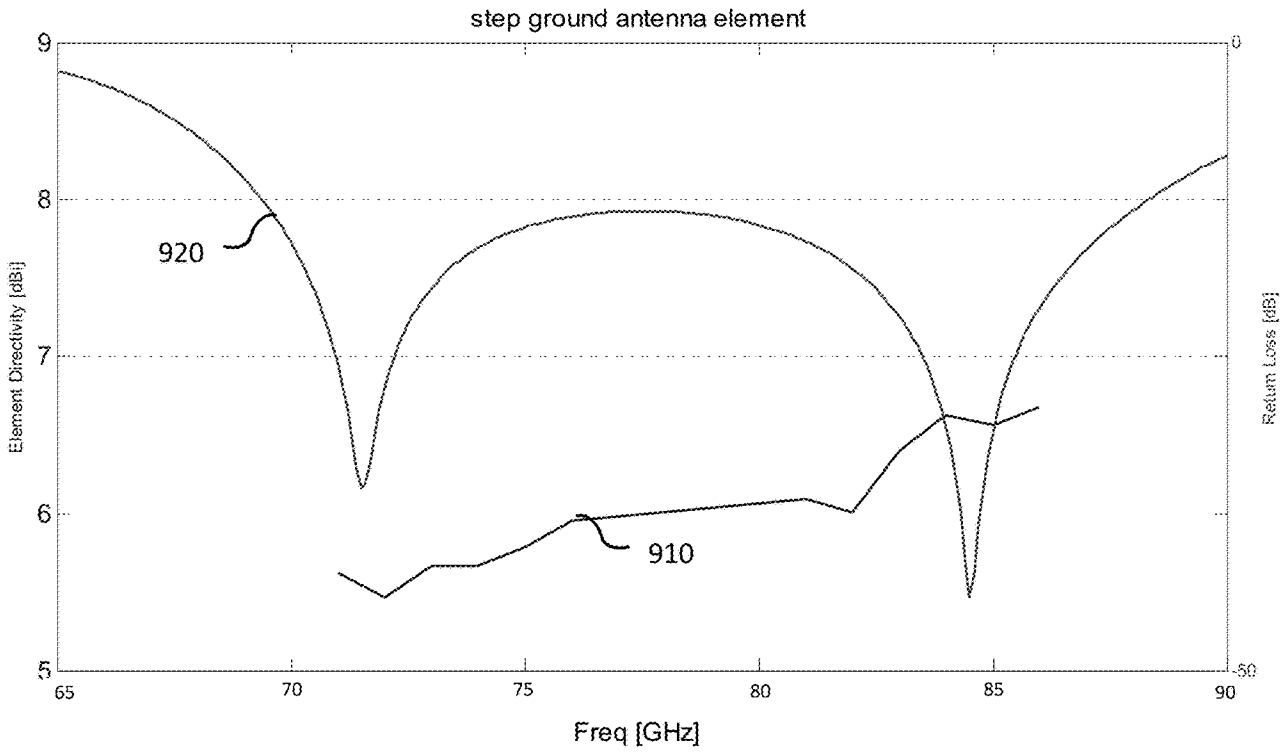
FIG. 9 shows a graph of the element directivity and return loss for the antenna structure of FIG. 8.

FIG. 8 shows a perspective view of an antenna structure using the vertical transition and power combiner structure. The antenna structure 800 has the patch antenna element 170, having a top metal layer, positioned above an opening 810 in the ground plane of layer 110. The 'H' slot 156 provides an opening in the ground plane of substrate layer 120 and is positioned below the opening 810, which is positioned above the short 172 of combiner 170. The opening 810 in the ground plane layer 110 can be modified to change the performance of the antenna element 102 relative to the height between the antenna element and its ground reference 102. The short 172 radiates the electrical signal from SLN2 up through the 'H' slot 156 to excite the antenna element 102. The end of the short 172 of the combiner 170 is positioned ¼ wavelength to a middle of the slot 156. A ground perimeter 812 on the layer 110 is coupled by vias 850 through other ground layers of the substrate layers 110, 120, 130, 140 of the antenna 800 structure to provide the stepped ground plane to improve the bandwidth performance. Referring to FIG. 9, the graph 900 shows the broad directivity of the signal element 910 across 71 to 86 GHz frequency band providing better than +5.5 dBi, in addition the antenna 800 provides consistent return loss profile 920.

Figure 10:
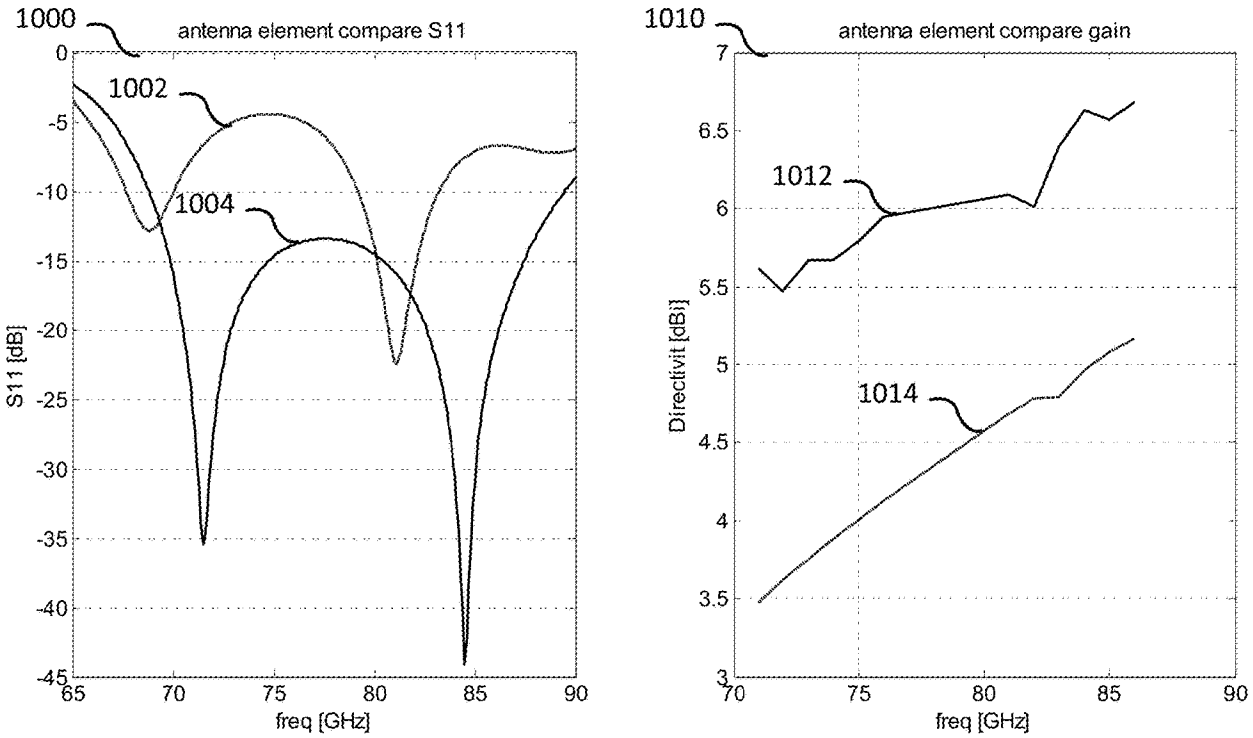
FIG. 10 shows graphs of the reflection coefficient and directivity of the antenna structure of FIG. 8 using the vertical transition and power combiner structure compared to a single ground plane 'H' slot fed patch antenna.

The graph 1000 in FIG. 10 shows the reflection coefficient graph where the reflection coefficient 1002 for the same antenna having a single ground plane is compared to the reflection coefficient 1004 of the antenna structure 800 having multiple stepped ground planes. Graph 1010 shows the improved directivity 1012 of the antenna 800 with stepped ground plane compared to the directivity 1014 of an antenna having a single ground plane. The stepped ground plane can provide approximate a 2 dBi improvement over a single ground plane configuration.

Figure 11:
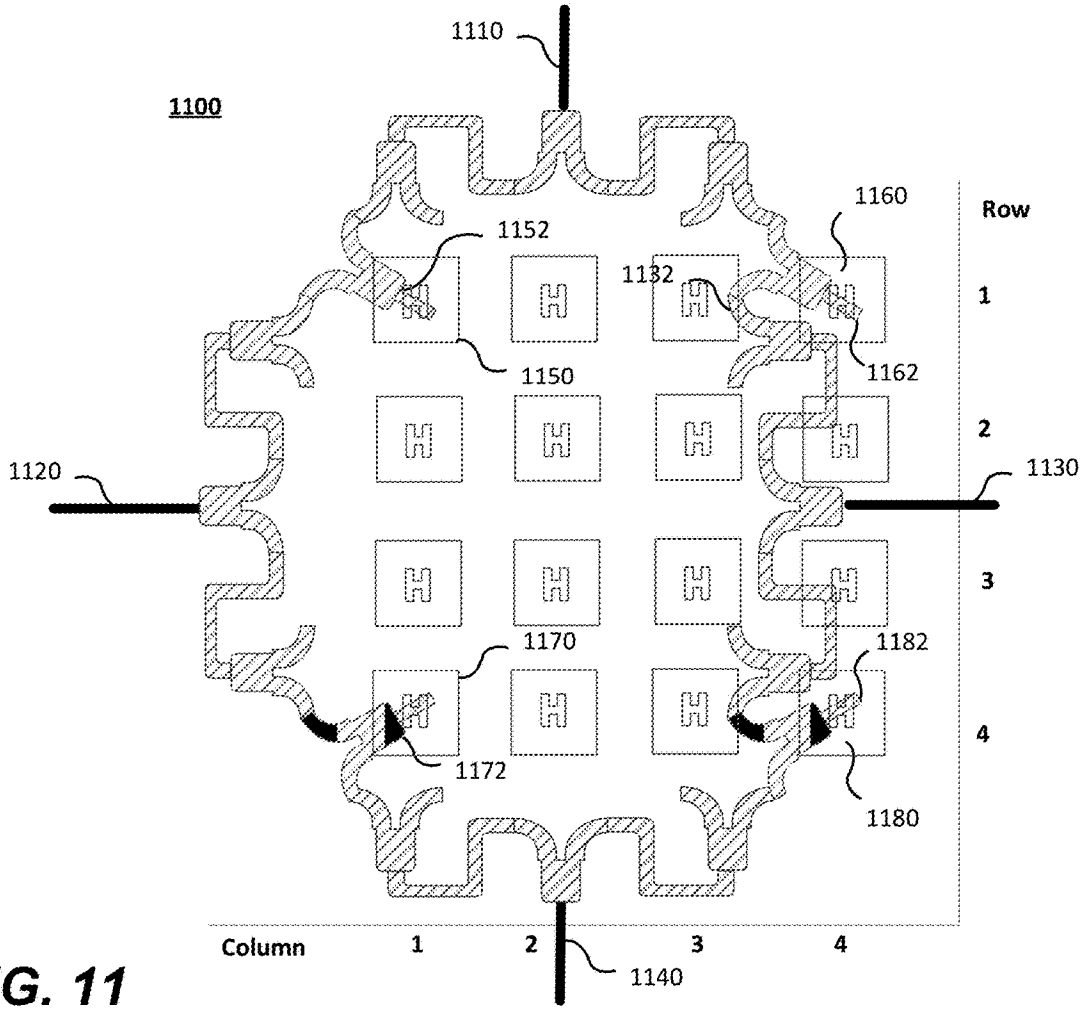
FIG. 11 shows a representation of a feed layer to outer antenna elements in an antenna array using the vertical transition and power combiner structure.

FIG. 11 shows a representation of a feed layer to outer antenna elements in an antenna array using the vertical transition and power combiner structure. The feed structure such as described in U.S. application Ser. No. 14/997,288, Filed Jan. 15, 2016 entitled Overlapping Linear Sub-array for Phased Array Antennas, the entirety of which is hereby incorporated by reference for all purposes, provides a feeding structure for overlapped phased array antennas. The feed structure provides a feeding network for phase array antenna where radiating elements are grouped into rows and columns. The antenna elements that are arranged in a row are fed by a common phase shifted signal and the radiating elements that are arranged in a column are fed by a common phase shifted signal. As such, each antenna element is fed by two different signals and acts as a phase shifter. In this example, a 4×4 array 1100 is shown where each of the antenna elements is provided with a row signal and a column signal which is then combined in the respective antenna element. For example in the first row the combiner 1152 of antenna element 1150 and the combiner 1162 of antenna element 1160 are connected to $1^{st}$ row input signal 1110. Similarly the remaining antenna elements in the $1^{st}$ row also receive signal 1110 as one of the inputs to the respective combiners. Combiner 1172 of antenna element 1170 and combiner 1182 of antenna element 1180 receive $4^{th}$ row input signal 1140. The $1^{st}$ column input signal 1120 is provided to antennal element 1150 and 1170 and $4^{th}$ input signal 1130 is provided to antenna elements 1160 and 1180. The multilayer overlapped linear array 1100 produces accurate phase values to all antenna element feed points to provide full beam steering capability.

Figure 12:
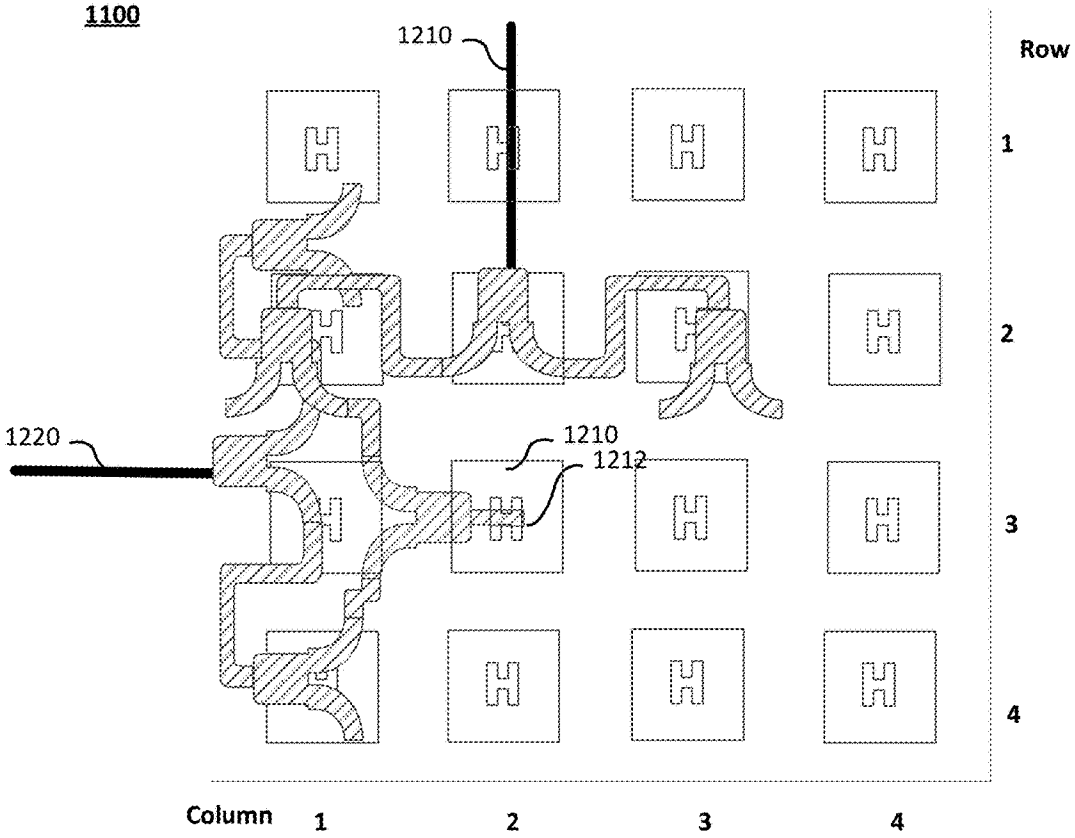
FIG. 12 shows a representation of a feed layer to a center antenna element in an antenna array using the vertical transition and power combiner structure.

Referring to FIG. 12, a center antenna element 1210 in the antenna array 1100 is feed by a $3^{rd}$ row input signal 1210 and $2^{nd}$ column input signal 1220 to the combiner 1212. The $3^{rd}$ row input signal 1210 drives the signal to each antenna element in the $3^{rd}$ row and the $2^{nd}$ column input signal 1220 drives all antenna elements in the $2^{nd}$ column. Although the antenna array 1100 has been described in a 4×4 sub-array structure the implementation may be expanded to larger arrays. The feed network and antenna element feed structure significantly reduces the number of control circuits needed from $N^2$ to 2N where N is the number of elements of side of a square phased array.

It would be appreciated by one of ordinary skill in the art that the system and components shown in FIGS. 1-12 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims.

The present disclosure provided, for the purposes of explanation, numerous specific embodiments, implementations, examples and details in order to provide a thorough understanding of the invention. It is apparent, however, that the embodiments may be practiced without all of the specific details or with an equivalent arrangement. In other instances, some well-known structures and devices are shown in block diagram form, or omitted, in order to avoid unnecessarily obscuring the embodiments of the invention. The description should in no way be limited to the illustrative implementations, drawings, and techniques illustrated, including the exemplary designs and implementations illustrated and described herein, but may be modified within the scope of the appended claims along with their full scope of equivalents.

While several embodiments have been provided in the present disclosure, it should be understood that the disclosed systems and components might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

The invention claimed is:

1. An N row×M column array of combiners comprising:

a first feed substrate layer includes a plurality of first strip-line signal feeds, each first strip-line signal feed being configured to provide a column high frequency signal to the N combiners of a respective one of M columns;

a second feed substrate layer includes a plurality of second strip-line signal feeds, each second strip-line signal feed being configured to provide a row high frequency signal to the M combiners of a respective one of N rows; and a combiner substrate layer interposed between the first feed substrate layer and the second feed substrate layer, the combiner substrate layer having the N×M combiners;

each combiner being coupled to a respective first strip-line signal feed and a respective second strip-line signal feed by vertical signal transitions through, respectively, the first feed substrate layer and the combiner substrate layer and wherein the combiner provides a respective resultant high frequency signal having a desired phase that is a vector sum of a phase of the respective received column high frequency signal from the respective first strip-line signal feed and a phase of the respective received row high frequency signal from the respective second strip-line.

2. The vertical electrical signal combiner of claim 1 wherein each substrate layer further provides a ground plane, each ground plane is coupled with another ground plane by a plurality of vertical interconnects between the substrate layers.

3. The vertical electrical signal combiner of claim 2 wherein a bottom ground plane is provided below the second feed substrate layer.

4. The vertical electrical signal combiner of claim 1 wherein the combiner includes a strip-line Y-coupler, the strip-line Y-coupler of the combiner substrate layer terminates in a short on the combiner substrate layer.

5. An antenna element comprising the vertical electrical signal combiner of claim 4, wherein the first feed substrate layer has a slot in a ground plane portion of the first feed substrate layer, the slot positioned above the short terminating the strip-line Y-coupler.

6. The antenna element of claim 5 wherein the slot is 'H' shaped.

7. The antenna element of claim 5 wherein each substrate layer further provides a ground plane, each ground plane is connected by a plurality of vertical interconnect between the substrate layers.

8. The antenna element of claim 6 wherein an end of the short terminating the strip line Y-coupler is ¼ guided wavelength to a middle of the slot.

9. The antenna element of claim 8 further comprising a top ground plane on top of the first feed substrate layer having an opening above the slot in the first feed substrate layer, wherein the top ground plane enables the antenna element to have an additional resonance frequency, which causes to a desired antenna operation bandwidth.

10. The antenna element of claim 9 further comprising the antenna positioned on top of an opening in the top ground plane, the antenna being radiated by the short through the slot.

11. An overlapped linear sub-array comprising:

a plurality of antenna elements arranged in an N row×M column array;

an N row×M column array of combiners comprising:

a first feed substrate layer includes a plurality of first strip-line signal feeds, each first strip-line signal feed being configured to provide a column high frequency signal to the N combiners of a respective one of M columns;

a second feed substrate layer includes a plurality of second strip-line signal feeds, each second strip-line signal feed being configured to provide a row high frequency signal to the M combiners of a respective one of N rows; and a combiner substrate layer interposed between the first feed substrate layer and the second feed substrate layer, the combiner substrate layer having the N×M combiners;

each combiner being coupled to a respective first strip-line signal feed and a respective second strip-line signal feed by vertical signal transitions through, respectively, the first feed substrate layer and the combiner substrate layer wherein the combiner provides a respective resultant high frequency signal having a desired phase that is a vector sum of a phase of the received column high frequency signal from the respective first strip-line signal feed and a phase of the respective received row high frequency signal from the respective second strip-line;

wherein the plurality of antenna elements positioned above the first feed substrate layer being configured to receive the respective resultant high frequency signals from the corresponding combiners;

a feeding network for providing the respective column high frequency signal to a respective first strip-line signal feed, and the respective row high frequency signal to a respective second strip-line signal feed.

12. The overlapped linear sub-array of claim 11 wherein in each antenna element the combiner includes a strip-line Y-coupler, the strip-line Y-coupler terminates in a short on the combiner substrate layer.

13. The overlapped linear sub-array of claim 11 wherein in each antenna element the first feed substrate layer has a slot in a ground plane portion of the first feed substrate layer, the slot positioned above the short terminating the strip-line of the Y-coupler.

14. The overlapped linear sub-array of claim 13 wherein the slot is 'H' shaped.

15. The overlapped linear sub-array of claim 13 wherein an end of short terminating the strip line Y-coupler is ¼ guided wavelength to a middle of the slot.

16. The overlapped linear sub-array of claim 13 further comprising a top ground plane on top of the first feed substrate layer having an opening above the slot in the first feed substrate layer, wherein the top ground plane enables the antenna element to have an additional resonance frequency.

17. The overlapped linear sub-array of claim 16 wherein the antenna is positioned on top of an opening in the top ground plane being radiated by the short through the slot.

18. The overlapped linear sub-array of claim 17 wherein the opening and the antenna are square shaped.

19. The overlapped linear sub-array of claim 13 wherein each substrate layer further provides a ground plane, each ground plane is coupled with another ground plane by a plurality of vertical interconnects.

20. The overlapped linear sub-array of claim 19 wherein a bottom ground plane is provided below the second feed substrate layer.

* * * * *